US008177323B2

(12) United States Patent
Stowe et al.

(10) Patent No.: US 8,177,323 B2
(45) Date of Patent: May 15, 2012

(54) VARIABLE DATA IMAGING

(75) Inventors: Timothy D. Stowe, Alameda, CA (US); Peter M. Kazmaier, Ontario (CA); Stephan Drappel, Ontario (CA)

(73) Assignee: Palo Alto Research Center Incorporated, Palo Alto, CA (US)

( * ) Notice: Subject to any disclaimer, the term of this patent is extended or adjusted under 35 U.S.C. 154(b) by 550 days.

(21) Appl. No.: 12/404,295

(22) Filed: Mar. 14, 2009

(65) Prior Publication Data

US 2010/0231639 A1 Sep. 16, 2010

(51) Int. Cl.
*B41J 29/38* (2006.01)
*B41J 2/015* (2006.01)

(52) U.S. Cl. ..... 347/20; 347/9

(58) Field of Classification Search ..... 347/3, 9, 347/20

See application file for complete search history.

(56) References Cited

U.S. PATENT DOCUMENTS

2002/0083858 A1 7/2002 MacDiarmid et al.
2004/0094067 A1* 5/2004 Oyanagi et al. ..... 106/31.58

FOREIGN PATENT DOCUMENTS

EP 2036719 A1 3/2009
WO WO2007098174 8/2007

* cited by examiner

*Primary Examiner* — Jason Uhlenhake
(74) *Attorney, Agent, or Firm* — Marger Johnson & McCollom PC

(57) ABSTRACT

According to some embodiments, a method for printing an image on a substrate includes applying a clear liftoff material to a surface of the substrate to form a sacrificial pattern, the clear liftoff material being substantially optically clear, and applying a first marking material to the surface of the substrate to form a first static pattern, a portion of the first static pattern arranged directly above a portion of the sacrificial pattern. The method further includes removing the portion of the first static pattern from the surface of the substrate, and removing the sacrificial pattern from the surface of the substrate.

22 Claims, 7 Drawing Sheets

VARIABLE DATA IMAGING

BACKGROUND

1. Technical Field

This disclosure relates to printing systems and processes, and more particularly to methods and systems for variable data imaging.

2. Description of the Related Art

Many current plate-based printing systems such as offset, screen, and flexographic presses can benefit from a way to introduce variable data without having to invest in new capital equipment, by finding a clean way of utilizing existing offset, screen, or flexographic printing infrastructure and marking materials to form variable data images. Today hybrid printing approaches involve continuous ink jet (CIJ) or drop on demand (DOD) inkjet matched with traditional inline flexographic, screen, or offset printing units. Hybrid systems make sense as an investment when most variable data information is a subset of a large static image. Thus, for bar coding, addressing, some personalization, security codes, or some short run print design alterations, such hybrid approaches make sense.

Unfortunately, most hybrid systems on the market today suffer from the issue that it is very challenging to use process colors to color match a spot color that is usually printed by flexo, screen, or offset processes using a static, plate-based approach. This is because the process colors are usually of a fundamentally different chemistry. Also, achieving repeatable matching of a spot color with four color processes is very difficult to control without extensive trial and error, which results in numerous wasted substrates. Furthermore, it is also impossible to match the exact gloss of inkjet inks with the screen, flexo, or litho inks used to form a static background image because the pile height and the extent of bleed into the substrate (bleed-through) are different for different ink chemistries.

For example, CIJ and DOD are usually water-based inks, which can have bleed-through issues due to the low viscosity of the ink. Water-based inks also do not perform well on metallic or plastic substrates. In addition, for packaging and textile applications, no one has been able to formulate inkjettable materials which are a brilliant titanium white or a shiny metallic with luster that match those in the flexographic and screen-printing processes.

Ultra-Violet (UV) inkjet machines have less of a bleed through issue but often have color gamut and color matching issues due to the amount of photoinitiators or acrylate based monomers which must be loaded into the ink as well as carrier fluids necessary to lower the viscosity of the ink so that it can be jetted. For example, pigment loading is usually far less for inkjettable inks. It is interesting that very high resolution has been achieved with inkjet technologies and it is not a primary technical barrier that limits the penetration of UV inkjet technologies into the packaging market. Instead, the far greater technical barrier is one of spot color matching for satisfying branding requirements. Some hybrid solutions are relying on a 6 or 8 variable data CIJ color process in order to approximate imprinted color matching with a background image printed with only a single spot color flexographic ink run, wherein the flexographic ink has a much lower print cost. It is this spot color requirement that is limiting full market penetration of hybrid solutions into some flexographic applications such as flexible/film product substrates or corrugated.

One example of the need to print variable data with spot colors includes business card applications where an exact match of the company logo color is important for branding purposes. Thus, most business cards print jobs are ordered in large queued up batches at a commercial printer in order to minimize the number of plates needed for offset printing. Digital techniques allow ordering on demand but can not often provide good enough color matching to be acceptable for company logos. This is especially true when metallic colors are used.

Another example is in the area of high-scale boutique rebranding where a low end product is sold at a substantial markup by repackaging it in a highly attractive label. The products are then resold at a high end boutique store or for special upscale events such as weddings or conferences. The ability to introduce variable data with metallic luster inks for special events would be a tremendous added advantage over other hybrid systems.

The T-shirt screen printing market is another good example where variable data printing of an individual name in a spot color matching the spot color of a company logo is ideal but not economically realizable with current digital printing technologies. Example embodiments of the invention address these and other disadvantages of the related art.

DETAILED DESCRIPTION OF EXAMPLE EMBODIMENTS

Figure 1:
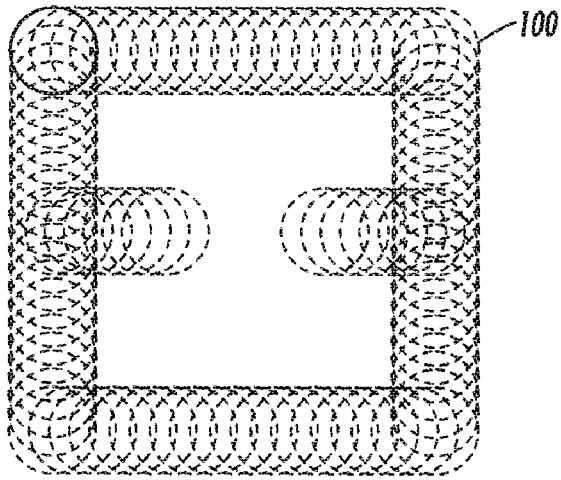
FIGS. 1-3 are top-view diagrams illustrating a negative sacrificial imaging liftoff process according to some example embodiments.

According to example embodiments, a digitally programmable variable image layer is created on a substrate from a clear ink-jetted material. This clear ink-jetted material forms a negative lift-off layer whose image is 'variable' in nature because the inkjet head can apply the material to a substrate in a digitally programmable fashion to form different images with each pass of a substrate.

A static image layer composed of a visible marking material is then applied to the substrate using a static plate or screen-based imaging technology such as flexography, screen, or offset. The visible image of the marking material that is initially applied is referred to as a static image because it can not be changed with each impression onto the substrate. In other words, the marking material is transferred to the substrate according to a fixed master lithographic offset plate, or stamping plate, or in the case of screen printing, a screen with a fixed pattern of openings to allow marking material to flow. Thus, in some embodiments, the static image layer may be formed using highly pigmented metallic screen-printed inks.

The clear ink-jetted material is then used to lift-off or reject a portion of the static image that was applied to regions of the substrate that were precoated with the clear ink-jetted material. Since the inkjetted lift-off material negative image was variably applied, once it is removed from the surface of the substrate it thereby forms a variable data image from the flexographic, screen, or offset inks themselves. In other words, when the clear ink-jetted material is removed, it forms the variable data image out of the marking material by removing those portions of the static image marking material layer that were laid down on top of the clear ink-jetted material.

For purposes of this disclosure, the inking material that is used to form the visible, static image layer, whether it is applied by flexographic, offset, screen-printed, or some other conventional technique, will be referred to as the marking material. For purposes of this disclosure, the clear, negative image forming, inking material that is used to lift off a portion of the statically-formed flexographic, screen, or offset image from the substrate will be referred to as the clear liftoff material. The clear liftoff material may also be referred to as a sacrificial material because most of it will be removed from the surface of the substrate in order to form the variable part of the image.

In order to match spot color at high process speed in the hybrid printing mode, the inventors have determined that the following characteristics for the clear liftoff material are preferable. The clear liftoff material should be easily jetted from a low viscosity state. That is, it should have a viscosity at some higher temperature state that is at or below 20 centipoise (cP). Once the clear liftoff material hits the substrate, it should be prevented from soaking into the substrate, that is, it should have sufficient viscosity once it hits the substrate so as not to bleed-through or experience dot gain.

The clear liftoff material should preferably form a smooth, low surface energy surface that substantially rejects the marking material. In some embodiments this smooth surface may be facilitated by using smoothing rollers to smash the clear liftoff material. Preferably, the top surface of the clear liftoff material protrudes above the maximum deviation in substrate roughness such that is has sufficient pile height to prevent the marking material from touching the substrate surface. Preferably, any marking material applied to the clear liftoff material will tend to bead up on the top surface of the clear liftoff material, such that the marking material may be easily removed from the substrate using a tacky web cleaner.

Preferably, a low temperature viscosity and tack of the clear liftoff material is high enough such that under substrate contact with a flexographic plate or offset blanket roller, none of the clear liftoff material will back transfer to the flexographic or offset components of the hybrid system. That is, in a low temperature state the viscosity of the clear liftoff material should be well above the viscosity of the marking material.

Preferably, the clear liftoff material may be heated over a relatively short time period to reduce its viscosity temporarily such that it can either be entirely split off of the marking substrate, or it can be split into two parts, one part lifting off of the substrate and one part adhering to the substrate. Just prior to splitting, the viscosity of the clear liftoff material should achieve a value that is lower than that of the marking material that is used to form the static part of the image. In some embodiments, prior to splitting but after the substrate is coated with the marking material, the marking material may optionally be spot cured with UV light so as to increase the viscosity of the marking material well above the viscosity of the clear liftoff material when the clear liftoff material is temporarily heated during splitting.

After the splitting and liftoff process, a means of eliminating the pile height of any remaining clear liftoff material is needed to inhibit gloss differential. For porous substrates there can be a much higher heated roller step at which the clear ink will entirely wick into the substrate. For non-porous films, there may be a higher temperature at which a tacky wicking material is used to remove most of the clear liftoff material, leaving behind only a very thin layer, which is sufficient to prevent a noticeable differential gloss on the substrate.

The inventors have determined that clear wax-based inks with a low viscosity at high temperature are ideally suited for use as the clear liftoff material. Examples of ideal lift off materials are those commonly referred to as solid inks or hot-melt inks, which are formulated to be absent of any colorant dyes or pigments, and which are based on a phase-change liquid crystal polymer wax-like material. Many examples of these materials have been disclosed by Xerox Corporation in various patents including U.S. Pat. No. 5,643,357, which is incorporated by reference in its entirety. These solid inks can be jetted at high temperature and will hit both porous and non-porous surfaces with relatively little dot gain, and upon contact with a substrate will quickly solidify so as not to bleed into uncoated substrates.

These types of inks also achieve a high pile height, which is desired as it allows the ink to cover substrate roughness. In addition, a smooth surface can be formed on top of the solid ink by subsequently smashing or flattening it, lowering the surface energy such that when a flexographic or offset image is applied to the substrate, very little marking material will actually transfer on top of the solid ink.

Experiments have shown that most of the marking material that is rolled over the solid inks described above is rejected by the solid ink. Adding a small amount of silicone additives to the solid ink waxes may be desirable as this will result in the rejection of substantially all of the marking material. The solid inks described above are also desirable because they are so high in viscosity (they are solid) that they will not back transfer onto a marking roller such as an offset blanket roller and contaminate the plate-based (offset or flexographic) static printing equipment of the hybrid system.

In the following paragraphs, example embodiments will be described with reference to the accompanying figures, where like reference numerals refer to like elements throughout. The example embodiments are not limiting, but rather are provided to be illustrative of the inventive aspects that may be common to many embodiments. In some cases, well-known details are omitted to avoid unnecessarily obscuring inventive aspects.

Furthermore, the numerous schematic diagrams that form part of this disclosure are not drawn to scale, and are intended to provide a relative, rather than an exact, description of the position of various components in a hybrid printing system. Those of ordinary skill will understand that the exact locations of the various illustrated components can vary based upon design and volume constraints of the actual system. Also, it should be pointed out that while the illustrated example embodiments show substrates in the form of a web, those of ordinary skill will appreciate that cut-sheet versions of each of these depicted embodiments can easily be realized utilizing the same inventive aspects.

In some instances, a component included in one of the example embodiments will be described as being "upstream" or "downstream" of another component in the example embodiment. The use of the term "upstream" is intended to refer to a direction opposite the path of the substrate as it moves through the system, while the use of the term "downstream" is intended to refer to the direction of the path of the substrate as it moves through the system. Thus, if a first component is indicated as being "upstream" of a second component, this means that a point on a substrate will encounter the first component before the second component.

Figure 2:
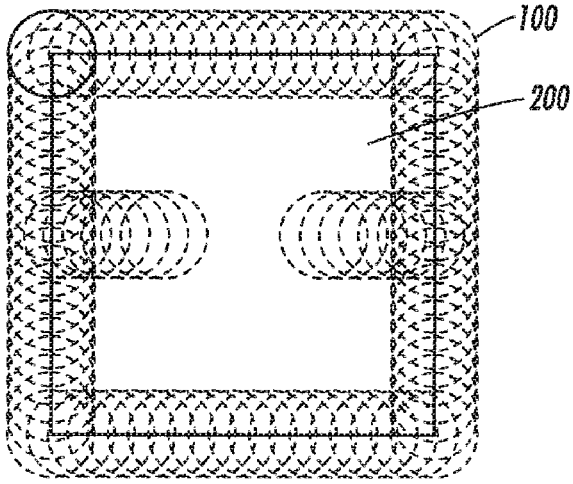
Figure 3:
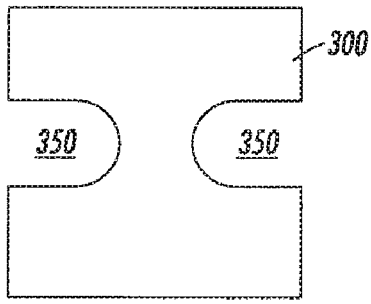

FIGS. 1-3 are top-view diagrams illustrating a negative imaging liftoff process according to some example embodiments. Referring to FIG. 1, a clear liftoff material is ink-jetted onto a surface of a substrate (not shown) to form a desired pattern 100. Referring to FIG. 2, a marking material is applied onto the surface of the substrate to form a static image layer 200. The marking material is applied such that portions of the static image layer 200 overlap onto the pattern 100. As shown in FIG. 2, the static image layer 200 is substantially square-shaped, although other shapes for the static image layer may of course be used.

Referring to FIG. 3, the pattern 100 composed of the clear liftoff material is removed, along with the overlying portions of the static image 200, leaving behind a dynamic, variable image 300. This technique makes it possible to exactly spot color match the variable image 300 with the static image 200 or any other static image portion printed elsewhere on the substrate, since the same marking material with the same chemical composition is used to form both the static image and the variable image.

Figure 8:
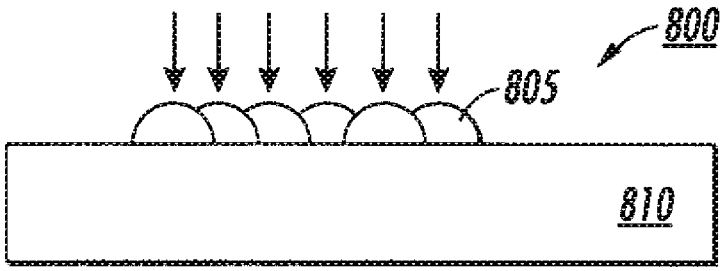
FIGS. 8-13 are sectional diagrams illustrating a negative imaging liftoff process according to another example embodiment.
Figure 9:
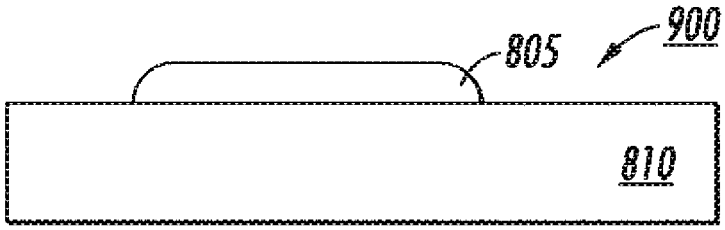
Figure 10:
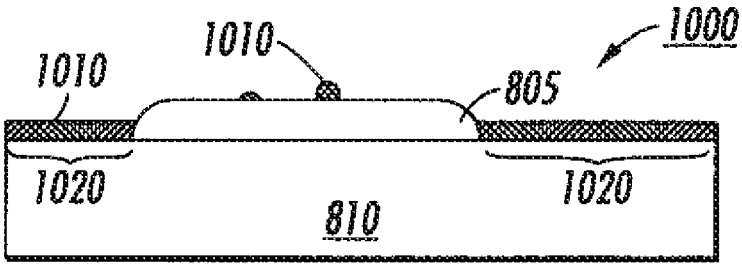

FIGS. 8-13 are sectional diagrams illustrating a negative imaging liftoff process according to another example embodiment. FIG. 8 is illustrative of process 800, where a clear liftoff material 805 is ink-jetted onto a selected region on the surface of substrate 810. Next, as illustrated in process 900 of FIG. 9, the clear liftoff material 805 is smashed or smoothed to form a smooth upper surface. In process 1000 of FIG. 10, a marking material 1010 is applied to the substrate 810. However, only variable image regions 1020 will remain firmly attached to the substrate as the clear liftoff material 805 rejects most of the marking material 1010. Any small residual amounts of marking material that remain on the surface of the clear liftoff material 805 can be easily removed from the liftoff material.

Figure 11:
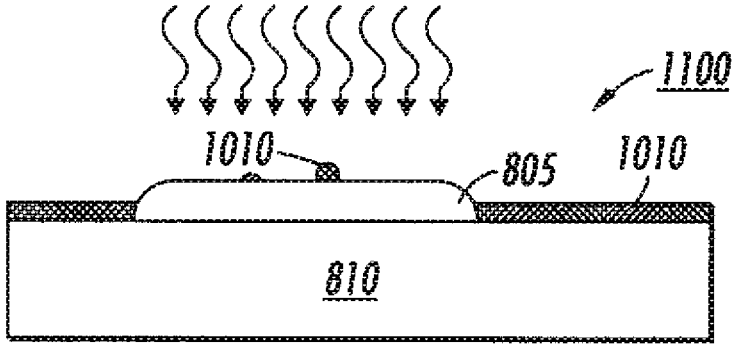
Figure 12:
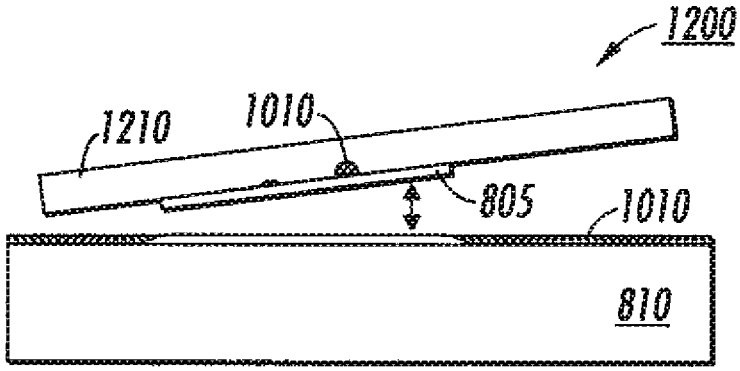
Figure 13:
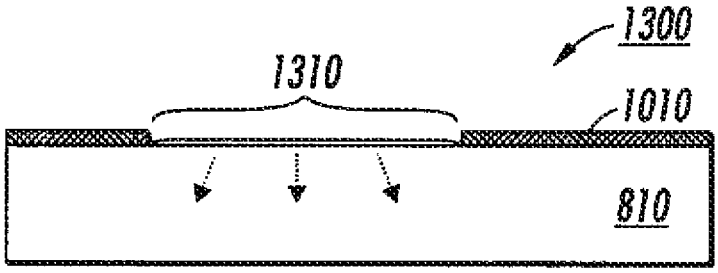

Next, in process 1100 as illustrated in FIG. 11, UV tacking of the marking material 1010 is performed to increase the viscosity of the marking material as well as increase its adhesion strength relative to the substrate. In addition, the UV lamp could optionally decrease the viscosity of the clear liftoff material 805. Next, in process 1200 of FIG. 12, a web cleaner 1210 is applied to remove the excess marking material 1010 on the surface of the clear liftoff material 805, as well as most of the clear liftoff material. In process 1300 of FIG. 13, excess clear liftoff material 805 remaining on the substrate 810 after the web cleaning process is driven into the substrate by heating, which assumes the substrate is sufficiently porous to wick away the residual excess amount of clear liftoff material. The processes 1200 and 1300 remove substantially all of the clear liftoff material 805 from the surface regions 1310 of the substrate 810. Like the example embodiments illustrated in FIGS. 1-3, the result is a dynamic, variable image region 1020 made from marking materials that are normally too viscous to be directly ink-jettable.

Figure 4:
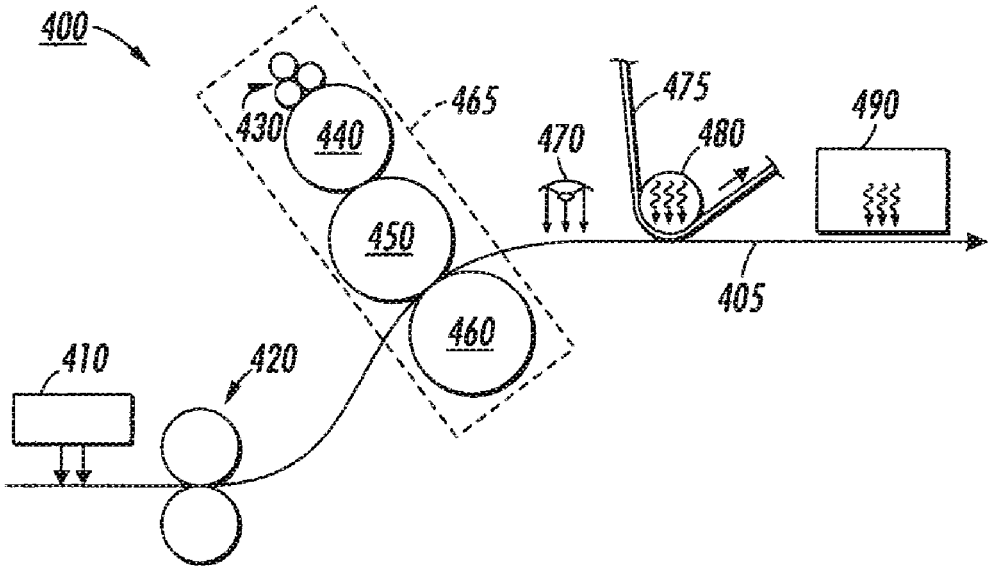
FIG. 4 is a schematic diagram that illustrates portions of a hybrid printing system according to an example embodiment.

FIG. 4 is a schematic diagram that illustrates portions of a hybrid printing system 100 according to an example embodiment. The system 400 prints upon a substrate 405 that is moving through the system in a left to right direction, as indicated by the arrowhead on the right side of the substrate 405. The components of the system 400 include an ink jet unit 410, smashing rollers 420, an offset printing press 465, a UV tacking unit 470, a heating roller 480, and a heater 490.

The offset printing press 465 includes forming rollers 430, image plate roller 440, blanket roller 450, and impression roller 460. Since the details and function of these components of the offset printing press 465 are well-known and not required for an understanding of the inventive aspects found in this disclosure, they will not be discussed in further detail here.

A method of forming a negative liftoff pattern according to an example embodiment will now be described with reference to FIG. 4. Initially, clear liftoff material is ink-jetted at a relatively high temperature onto a selected portion of the substrate 405 using the ink jet unit 410. During the jetting process the viscosity of the clear liftoff material is preferably between about 1 and about 10 cP. When the clear liftoff material hits the substrate 405 it will instantly go to a high viscosity state due to the rapid transfer of its thermal energy to the substrate. At this point, the clear liftoff material may have some topography which is not ideal in terms of rejection of the marking material that is subsequently applied by the offset printing press 465.

Consequently, the next process is the smashing of the clear liftoff material using the smashing rollers 420 to create a smooth surface. In some embodiments, a small amount of copolymer composed of silicone like material having a side chain group having a chemical affinity to the clear liftoff base material may be added in small amounts to the composition of the clear liftoff material in order to prevent the smashing rollers 420 from picking up any of the clear liftoff material. To further prevent this situation, some example embodiments may additionally, or in lieu of the silicone oil additives, use smashing rollers 420 with very low surface energy. For example, a TEFLON-coated aluminum drum may be used as the smashing roller 420.

Next, the marking material (not shown) is applied to the substrate 405 using the offset printing press 465 in order to create a static image. Some of the marking material is applied to the surface of the clear liftoff material, but since the clear liftoff material was previously smoothed out as described above it will reject most of the marking material. Some residual amount of offset ink droplets will remain on top of the clear liftoff material. The following paragraphs will describe a preferred method of removing this excess marking material in accordance with an example embodiment.

According to some embodiments, the viscosity of the marking material is made much higher than the viscosity of the clear liftoff material using the UV tacking unit 470, which is arranged to emit UV light onto the substrate 405. In some embodiments, the clear liftoff material may have chemical bonds that break down in the presence of UV light, decreasing the viscosity of the clear liftoff material. In this case, the UV tacking unit 470 serves the dual purpose of simultaneously increasing the viscosity of the marking material while decreasing the viscosity of clear liftoff material.

In other embodiments, the viscosity of the clear liftoff material may alternatively be decreased by using a heating stage. If heating is used, a hot roller configuration would be optimal. In this case, when the clear liftoff material is heated, it will have a viscosity in the range of about 5,000 cP to about 50,000 cP. This range is low enough to cause the clear liftoff material to split from the substrate under the applied heat but high enough so the clear liftoff material does not soak into the porous substrate.

Next, the substrate 405 is contacted with a web cleaner/stripper 475 using a heating roller 480. The web cleaner/stripper 475 is ideally an absorbent material capable of picking up the marking material very efficiently but not too sticky as to cause paper fiber pickup. Because the viscosity of the clear liftoff material was previously decreased using the UV tacking unit 470, splitting of the clear liftoff material is promoted when the substrate 405 contacts the web cleaner/stripper 475 and the heating roller 480, and the clear liftoff material is removed from the substrate along with the excess marking material that remained on top of the clear liftoff material. After splitting is accomplished in the clear liftoff layer, the negative variable image is thus formed on the substrate 405. Heater 490 may optionally be used to finally set the ink and drive any clear residual lift-off material into a porous substrate.

According to an alternative embodiment, the web cleaner/stripper 475 is capable of being temporarily disengaged from the hybrid printing system 400 during high-volume normal duplicating operations. This would allow offset and flexographic print shops to run a series of variable data proofs using the actual inks they will use for the final printing or packaging. This offers a tremendous advantage for short run proofing and market trials or variable data applications.

Figure 5:
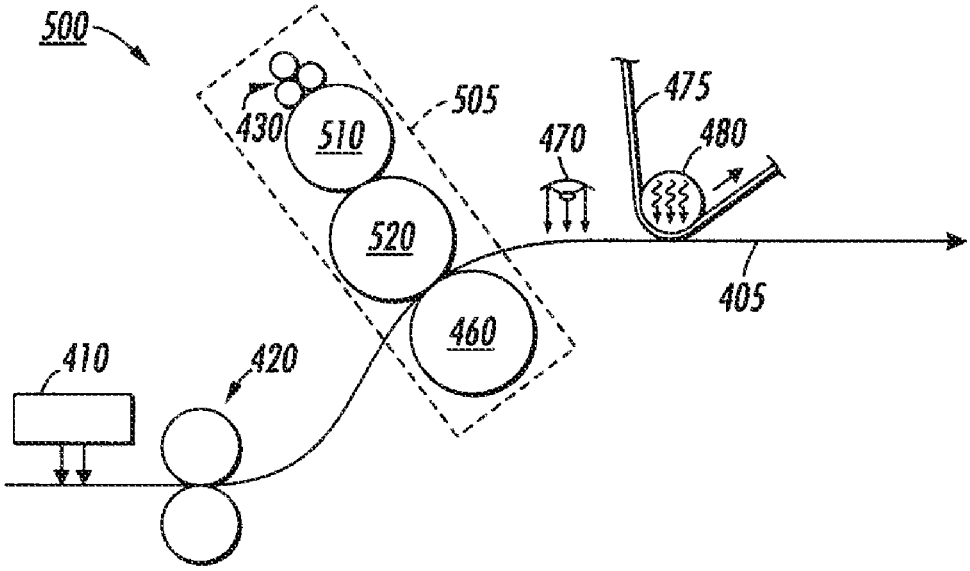
FIG. 5 is a schematic diagram that illustrates portions of a hybrid printing system according to another example embodiment.

FIG. 5 is a schematic diagram that illustrates portions of a hybrid printing system 500 according to another example embodiment. The system 500 is very similar to the system 400 illustrated in FIG. 4, but uses a flexographic printing press 505 (and flexographic ink) rather than an offset printing press 465 (and offset ink). The flexographic printing press 505 includes an Anilox roller 510 and a flexo roller 520 rather than the image plate roller 440 and the blanket roller 450 of the offset printing press 465. Since the details and function of these components of the flexographic printing press 505 are well-known and not required for an understanding of the inventive aspects found in this disclosure, they will not be discussed in further detail here. With the exception of using the flexographic printing press 505 to apply the marking material to the substrate 105, the process of forming a negative variable image using the system 500 is substantially the same as the one described above for system 400.

Figure 6:
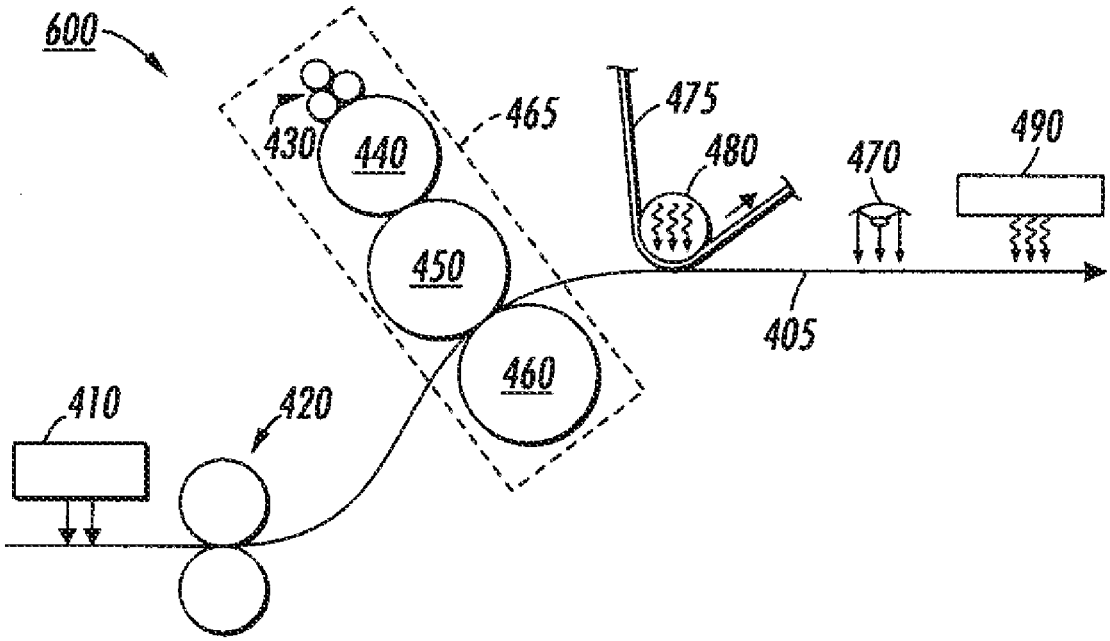
FIG. 6 is a schematic diagram that illustrates portions of a hybrid printing system according to still another example embodiment.

FIG. 6 is a schematic diagram that illustrates portions of a hybrid printing system 600 according to still another example embodiment. The system 600 prints upon a substrate 405 that is moving through the system in a left to right direction, as indicated by the arrowhead on the right side of the substrate 405. The components of the system 600 include an ink jet unit 410, smashing rollers 420, an offset printing press 465, a heating roller 480, a UV tacking unit 470, and a heater 490. The system 600 is similar to the system 400 of FIG. 4, but in system 600 the UV tacking of the marking material occurs after any residual marking material on the clear liftoff material is removed using the web cleaner/stripper 475 and heating roller 480.

A method of forming a negative liftoff pattern according to another example embodiment will now be described with reference to FIG. 6. Initially, clear liftoff material is ink-jetted at a relatively high temperature onto a selected portion of the substrate 405 using the ink jet unit 410. During the jetting process the viscosity of the clear liftoff material is preferably between about 1 and about 10 cP. When the clear liftoff material hits the substrate 405 it will instantly go to a high viscosity state due to the rapid transfer of its thermal energy to the substrate. At this point, the clear liftoff material may have some topography which is not ideal in terms of rejection of the marking material that is subsequently applied by the offset printing press 465.

Consequently, the next process is the smashing of the clear liftoff material using the smashing rollers 420 to create a smooth surface. In some embodiments, silicone oil may be added to the composition of the clear liftoff material in order to prevent the smashing rollers 420 from picking up any of the clear liftoff material. To further prevent this situation, some example embodiments may additionally, or in lieu of the silicone oil additives, use smashing rollers 420 with very low surface energy. For example, a TEFLON-coated aluminum drum may be used as the smashing roller 420.

Next, the marking material (not shown) is applied to the substrate 405 using the offset printing press 465 in order to create a static image. Some of the marking material is applied to the surface of the clear liftoff material, but since the clear liftoff material was previously smoothed out as described above it will reject most of the marking material. Some residual amount of marking material will remain on top of the clear liftoff material. The following paragraphs will describe a method of removing this excess marking material in accordance with another example embodiment.

If the viscosity of the marking material is low enough (perhaps around 10,000 cP) as is the case for flexographic inks after a small amount of fixing or tacking, it may be possible to directly remove the excess marking material from the surface of the clear liftoff material by allowing the excess marking material to entirely wick into the web cleaner/stripper 475. In this case the final hard tacking step using the UV tacking unit 470 could occur after the web cleaning step.

Preferably, in this embodiment the tackiness of the marking material relative to the substrate should be much higher than the tackiness of the marking material relative to the clear liftoff material, to prevent the web cleaner/stripper 475 from removing marking material in the image areas (the areas that do not have the clear liftoff material). Optionally, using a substrate 405 that is porous will also lessen the chance that the web cleaner/stripper will remove marking material from the image areas. Using a waterless offset ink as the marking material, especially if the clear liftoff material includes silicone oil, further improves the ability of the web cleaner/stripper 475 from removing the marking material from the surface of the clear liftoff material.

Next, the final UV tacking step is performed on the marking material using the UV tacking unit 470. Finally, the residual clear liftoff material needs to be removed to prevent differential gloss. In system 600, this is accomplished using the heater 490. Since the marking material has already been tacked, the final heating stage can be much hotter, which eliminates the pile height of the residual clear liftoff material by driving it into the porous substrate 405. For non-porous substrates such as metal films or plastic, there may be other chemical or mechanical cleaning methods to remove residual amounts of the clear liftoff material such as chemical dissolution.

Figure 7:
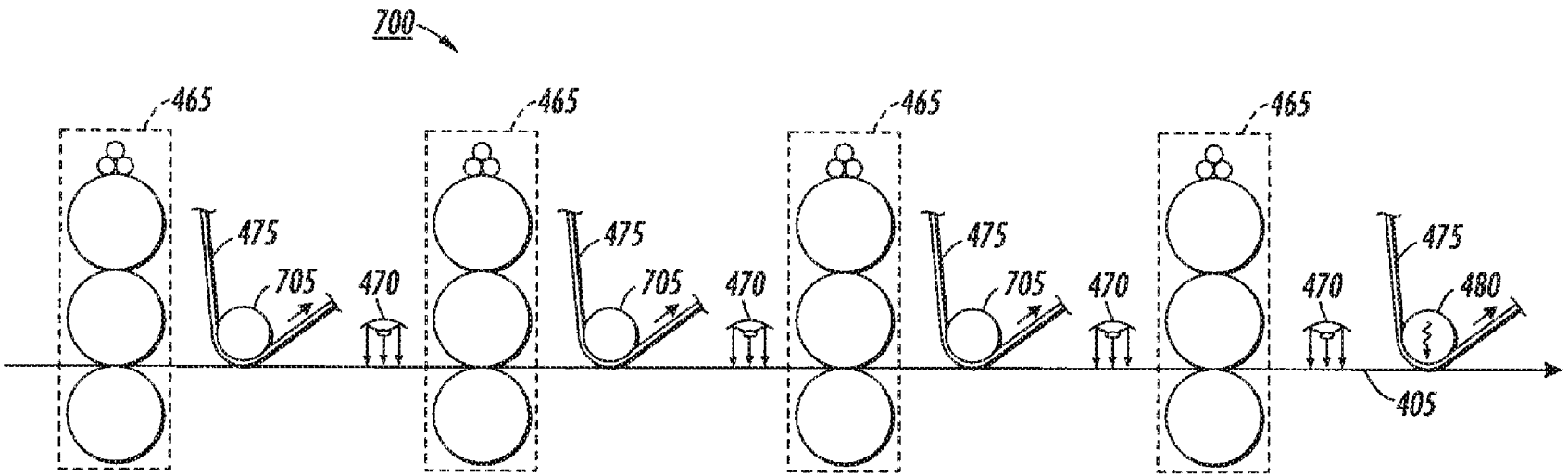
FIG. 7 is a diagram that illustrates a portion of a hybrid printing system suitable for implementing a four-color process with exact matching of variable data according to an example embodiment.

It should be apparent that the method described above can easily be extended to multiple web-cleaning stages if overlapping marking materials of different color are simultaneously being used. For example, FIG. 7 is a diagram that illustrates a portion 700 of a hybrid printing system suitable for implementing a four-color process with exact matching of variable data according to an example embodiment. In this embodiment, the portion 700 could, for example, replace the single heating roller 480/UV tacking unit 470 stage of the system 600.

Referring to FIG. 7, the portion 700 includes four stages, each stage including an offset printing press 465 and a web cleaner/stripper 475. The first three stages apply the web cleaner/stripper 475 to the substrate 405 using a roller 705, while the last stage uses a heating roller 480, because heating only needs to occur at the last stage where the clear liftoff material is to be split away from the substrate 405. In portion 700, the web cleaners/strippers 475 are used to clean off the top residue from the clear liftoff material for each process color and only after all four colors are printed is the clear liftoff material removed by heating or some other means.

Complete removal and/or rejection of the marking material on top of the clear liftoff material using the web cleaners/strippers 475 is preferred at each stage, otherwise the surface energy properties of the clear liftoff material are likely to be modified and ink build-up, mixing, and transfer between color stations may occur. However, in some alternative embodiments it may still be possible to use only the final web cleaner/stripper 475, if the four process colors can stick to the clear liftoff material very well after being spot cured by the corresponding UV tacking unit 470, but are almost entirely rejected before being spot cured. In this case the clear liftoff material can still be split efficiently. Therefore the first three web cleaners/strippers 475 found in portion 700 may be optional depending on the dynamics of the ink tackiness.

For plastic or metal substrates that are non-porous, it may be ideal to remove residual amounts of clear liftoff material via other methods besides heating. For example, if productivity requirements are not too high, a chemical wash that does not attack the substrate or the marking material could be used to wash away the residual lift-off material.

Figure 14:
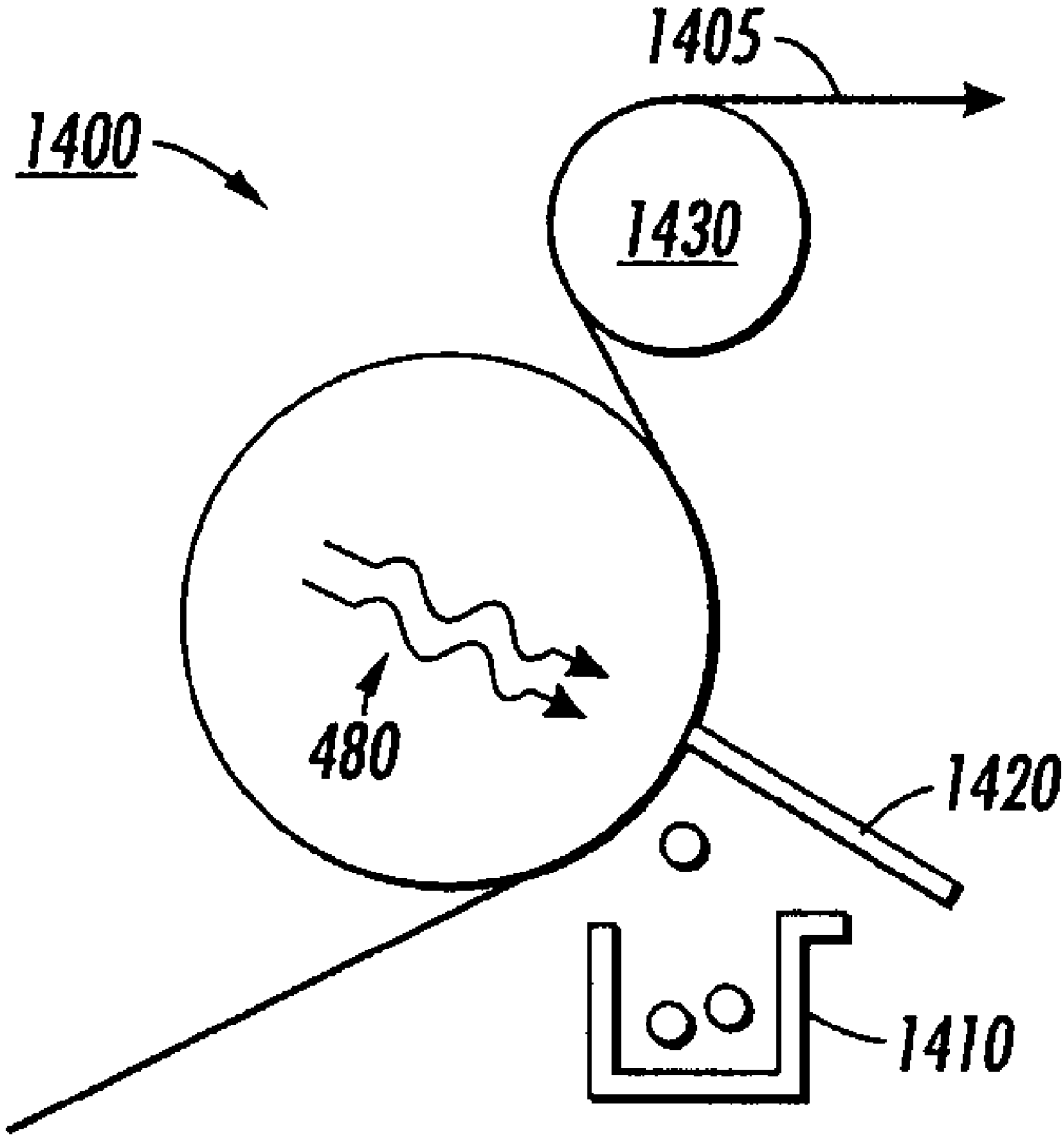
FIG. 14 is a schematic diagram that illustrates a mechanical scraper suitable for use in a hybrid printing system according to some example embodiments.

Other means for cleanly removing the lift-off material could involve mechanical scraping. FIG. 14 is a schematic diagram that illustrates a mechanical scraping unit 1400 that is suitable for use in a hybrid printing system according to some example embodiments. The mechanical scraping unit 1400 includes a heating roller 480, a waste catcher 1410, a doctor blade 1420, and a guiding roller 1430. A plastic or metallic substrate 1405, such as aluminum, passes through the scraping unit 1400 from left to right, and as it passes, the doctor blade 1420 operates to scrape the clear liftoff material from the substrate, where it falls into the waste catcher 1410 for subsequent disposal.

Mechanical scraping as illustrated in FIG. 14 may not be suitable for paper substrates, but if metallic substrates are used and the clear liftoff material incorporates silicone oil and is heated, then mechanical scraping is not out of the question. Metallic or plastic substrates are generally more robust than paper substrates, and better resist shearing by the doctor blade 1420. There is also significantly less surface adhesion between the clear liftoff material and the metallic substrate or a plastic substrate than with a paper substrate.

Finally, there are some applications where substrates are coated with varnish for additional gloss. In such cases, it may be possible to forgo the final liftoff of the clear liftoff material because the varnish overcoats the clear liftoff material anyway. In these cases, only the rejection of the marking material or their complete removal during the liftoff step would be necessary.

In the preceding paragraphs, example embodiments of the invention were described. These embodiments are presented for purposes of illustration rather than of limitation, and minor changes may be made to the example embodiments without departing from the inventive principle or principles found therein.

The invention claimed is:

1. A method for printing an image on a substrate, the method comprising:

applying a clear liftoff material to a surface of the substrate to form a sacrificial pattern, the clear liftoff material being substantially optically clear;

applying a first marking material to the surface of the substrate to form a first static pattern, a portion of the first static pattern arranged directly above a portion of the sacrificial pattern;

removing the portion of the first static pattern from the surface of the substrate;

after removing the portion of the first static pattern from the surface of the substrate, tacking a remaining portion of the first static pattern using an Ultra-Violet (UV) light; and removing the sacrificial pattern from the surface of the substrate.

2. The method of claim 1, further comprising, before applying the first marking material, smoothing the top surface of the sacrificial pattern.

3. The method of claim 1, in which applying the clear liftoff material to the surface of the substrate comprises ink jetting the clear liftoff material at a temperature such that a viscosity of the clear liftoff material is less than about 20 centipoise (cP) before it contacts the substrate.

4. The method of claim 3, in which applying the clear liftoff material to the surface of the substrate further comprises ink jetting the clear liftoff material at the temperature such that the viscosity of the clear liftoff material is about 1 to about 10 centipoise (cP) before it contacts the substrate.

5. The method of claim 1, further comprising simultaneously increasing a viscosity of the first marking material and decreasing a viscosity of the clear liftoff material by exposing the first marking material and the clear liftoff material to an Ultra-Violet (UV) light.

6. The method of claim 5, further comprising using a chemical wash to selectively dissolve the clear lift-off material layer without attacking the marking material or substrate.

7. The method of claim 5, in which decreasing the viscosity of the clear liftoff material comprises breaking a chemical bond in the clear liftoff material using the UV light.

8. The method of claim 5, in which decreasing the viscosity of the clear liftoff material comprises heating the clear liftoff material.

9. The method of claim 1, in which the clear liftoff material comprises silicone oil or a silicone-like copolymer that is structured to repel the first marking material.

10. The method of claim 1, in which removing the portion of the first static pattern from the surface of the substrate and removing the sacrificial pattern from the surface of the substrate comprises:

heating the clear liftoff material such that it splits from the substrate; and picking up the portion of the first static pattern and picking up the clear liftoff material using a cleaning roller.

11. The method of claim 10, in which heating the clear liftoff material such that it splits from the substrate comprises heating the clear liftoff material such that a viscosity of the clear liftoff material is in the range of 5,000 to about 50,000 centipoise (cP).

12. The method of claim 1, in which removing the sacrificial pattern from the surface of the substrate comprises decreasing a viscosity of the clear liftoff material such that the clear liftoff material is absorbed into the substrate.

13. The method of claim 12, in which a tackiness of the marking material relative to the substrate is greater than a tackiness of the clear liftoff material relative to the substrate.

14. The method of claim 1, in which removing the portion of the first static pattern from the surface of the substrate and removing the sacrificial pattern from the surface of the substrate comprises mechanically scraping the clear liftoff material and the portion of the first static pattern from the surface of the substrate.

15. The method of claim 1, further comprising:

applying a second marking material to the surface of the substrate to form a second static pattern, a portion of the second static pattern arranged directly above the portion of the sacrificial pattern; and removing the portion of the second static pattern from the surface of the substrate.

16. A system comprising:

a first unit arranged to inkjet a clear liftoff material onto a selected portion of a surface of a substrate;

a second unit arranged to apply a first amount of marking material to the surface of the substrate and a surface of the clear liftoff material, the first amount of marking material including a second amount of marking material that is applied to the surface of the clear liftoff material;

a tacking unit positioned downstream of the second unit, the tacking unit arranged to emit ultra-violet (UV) light onto the substrate; and a heating roller and a web cleaner positioned downstream of the second unit, the heating roller adapted to encourage splitting of the clear liftoff material, the web cleaner adapted to remove the second amount of marking material and the clear liftoff material from the substrate.

17. The system of claim 16, the second unit comprising an offset printing unit.

18. The system of claim 16, further comprising a heater disposed downstream of the heated roller.

19. The system of claim 16, in which the tacking unit is disposed upstream of the heated roller.

20. The system of claim 16, in which the tacking unit is disposed downstream of the heated roller.

21. The system of claim 16, the second unit comprising a flexographic printing unit, the tacking unit disposed between the flexographic printing unit and the heating roller.

22. The system of claim 16, further comprising a scraper configured to scrape the clear liftoff material from the surface of the substrate.

* * * * *